US005077923A

United States Patent [19]

Rockola et al.

[11] Patent Number: 5,077,923

[45] Date of Patent: Jan. 7, 1992

[54] PROGRAM DISPLAY FOR COIN OPERATED COMPACT DISC PHONOGRAPH

[75] Inventors: Donald C. Rockola, Chicago; Shuja Haque, Northbrook, both of Ill.

[73] Assignee: Rock-Ola Manufacturing Corporation, Addison, Ill.

[21] Appl. No.: 561,569

[22] Filed: Aug. 6, 1990

Related U.S. Application Data

[63] Continuation-in-part of Ser. No. 405,528, Sep. 7, 1989.

[51] Int. Cl.[5] ..... G09F 11/30

[52] U.S. Cl. ..... 40/510; 40/475; 40/532

[58] Field of Search ..... 40/389–475, 40/510–518, 531, 532

[56] References Cited

U.S. PATENT DOCUMENTS 2,909,761 10/1959 Rockola ..... 40/389 X
3,268,868 8/1966 Rockola ..... 40/389 X
3,412,496 11/1968 Hendricks et al. ..... 40/389
4,831,758 5/1989 Williams et al. ..... 40/389 X

*Primary Examiner*—Kenneth J. Dorner
*Assistant Examiner*—J. Bonifanti
*Attorney, Agent, or Firm*—McCaleb, Lucas & Brugman

[57] ABSTRACT

A compact disc program display mechanism in which album covers are displayed on pages similar to a book presentation; each album having a selection indicia visually associated therewith for selection by the customer. The several pages are turned in response to energization of an electrical drive motor and gear train, controlled manually by customer accessible push button switches or automatically by a programmed microprocessor. Each energization of the motor serves to pivotally turn a pair of pages in one direction with the indexing movements of the pages being controlled by an opto-switch and the microprocessor for deenergizing the drive motor at predetermined page movement. Reverse movement of the pages is also conditioned by the opto-switch which signals the micro-processor to reverse the rotational direction of the drive motor. Each page displays album covers on both its front and back sides for customer viewing.

9 Claims, 4 Drawing Sheets

PROGRAM DISPLAY FOR COIN OPERATED COMPACT DISC PHONOGRAPH

This application is a continuation in part of our prior, co-pending application Ser. No. 405,528, filed Sept. 7, 1989.

This invention relates to automatic phonographs and more particularly to selectively operable program displays therefor.

With the development of compact disc or C.D. records, the adaptation of coin operated phonographs to C.D. record use has followed. One of the heretofore unsolved problems confronted by the developers of the C.D. automatic phonograph or "juke box" involves the development of an operationally dependable system for displaying the available record selections to the customers.

BRIEF SUMMARY OF THE INVENTION

In brief the present invention provides a selectively operable display mechanism in which album covers for C.D. records stored in the magazine of the "juke box" are displayed on a plurality of pages, as in a book, which are selectively turned between limits by energizing a motorized drive means, either manually by customer accessible switches or automatically by means of a microprocessor and its attendant computer program. Novel opto-switch means serve to deenergize the drive means at selective limits of page movement and to cause reverse movements of the drive means for reversing page movement.

A principle object of this invention is to provide a program display of the foregoing described character.

Another important object of this invention is to provide a light responsive system for controlling bi-directional movement of a plurality of arcuately moveable pages of a program display.

Still another important object of this invention is to provide a light responsive control system for a record or compact disc program display, as aforesaid, which is simple, inexpensive and accurately dependable in operation.

Having described this invention the above and further objects, features and advantages thereof will be recognized by those with skill in the art from the following detailed description of a preferred embodiment thereof, illustrated in the accompanying drawings and representing the best mode presently contemplated for enabling those skilled in this art to practice this invention.

IN THE DRAWINGS

DESCRIPTION OF THE PREFERRED EMBODIMENT

Figure 1:
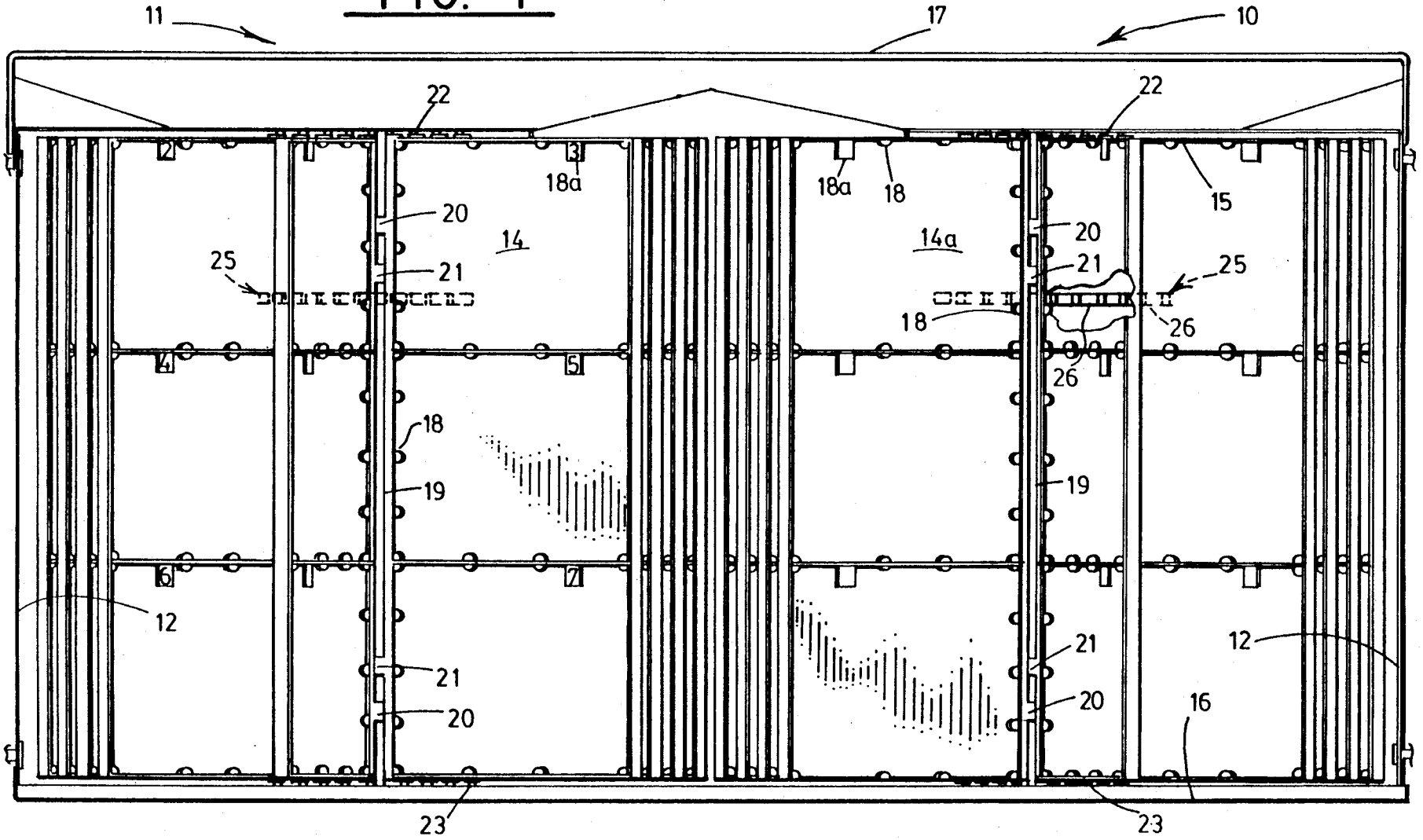
FIG. 1 is a front elevational view of a program display in accordance with this invention.

Referring now in detail to the drawings, attention is directed initially to FIG. 1, showing the program display mechanism indicated generally at 10, as comprising a generally horizontally extending rectangular shaped housing 11 having an open front formed by rearwardly converging sidewalls 12, 12 flanking a planar back wall 13 (see FIG. 2) over which are mounted a plurality of pivotally moveable pages 14 and **14*a*. The pages are located in two side by side book arrays so that the pages 14 and 14*a* in each array, respectively, are openly visible to the customer. Parallel top and bottom walls 15 and 16 join the walls 12 and 13 as shown in FIG. 2 and an upwardly and forwardly converging cap 17 over covers the top wall 15 and merges with side walls 12**.

Each page is divided vertically into three equal rectangular areas or fields over each of which is mounted the cover of a compact disc record album. Plural holder tabs, indicated at 18 in FIG. 1, are provided along the sides of each field to hold the album covers in place. In addition each of the fields and their corresponding counterparts on the reverse side of each page bears a larger rectangular tab **18*a* which extends in front of a mounted album cover for carrying appropriate indicia to visually indicate the identification of that particular selection (see FIG. 1**). In this manner the customer may study the description of the recording as set out on the album cover before making his or her selection.

Each page preferably is molded as a unified member from a suitable plastic material and provided with a heavier weight or thickened semi-cylindrical pintle section 19 extending along one lengthwise extending edge thereof. Two pairs of heavy triangular shaped actuator tabs 20, 21 extend or project outwardly of the semi-cylindrical outer edge of the pintle section of each page adjacent the upper and lower ends thereof. The extreme outer ends of each pintle section 19 are cylindrical to serve as pivot centers for each page, as will be described more fully presently. The formation of a page is symmetrical such that it may be reversely positioned end for end to simplify assembly.

Figure 2:
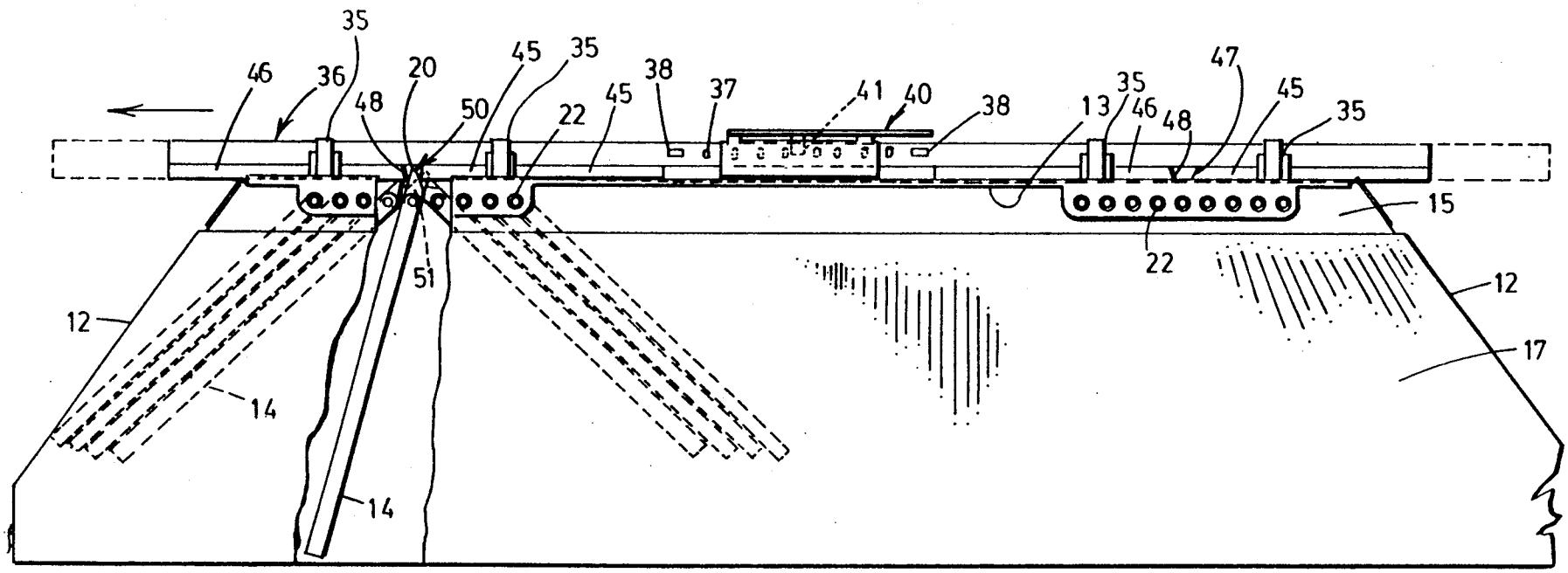
FIG. 2 is a top plan view of the display shown in FIG. 1.

From FIGS. 1 and 2 it will be noticed that opposing aligned cylindrical pivot openings 22 and 23 are provided in the top and bottom walls 15 and 16, respectively, for receiving the cylindrical upper and lower ends of the pintle section of each page whereby to support the several pages for arcuate pivoting movement about parallel longitudinal axes. It will be understood that such pivot center openings are arranged in separated groups one near each side wall 12 of the housing, corresponding to location of the two page groups or arrays as mentioned above.

Figure 1A:
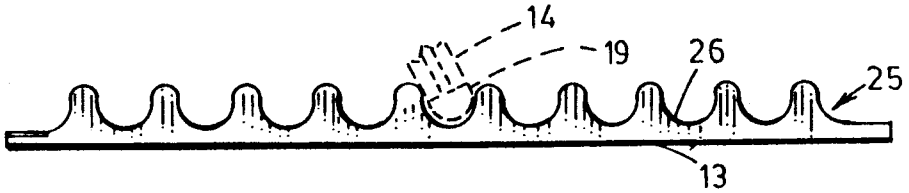
FIG. 1A is an enlarged top plan of a page guide comb shown in FIG. 1.

Also, it is to be noted that mounted on the front face of the back wall of the housing, parallel to and relatively adjacent the upper wall 15 are a pair of laterally spaced transversely extending elongated guide combs 25, one for each group of pages. Each comb 25 has plural semi-circular laterally spaced recesses 26 extending inwardly of one outer edge or face thereof whereby each recess is openly receptive of a pintle section 19 (see FIG. 1A). The two guide combs serve to intermediately support the light weight pages and rigidify the same laterally, particularly during their pivotal page turning movements.

Figure 3:
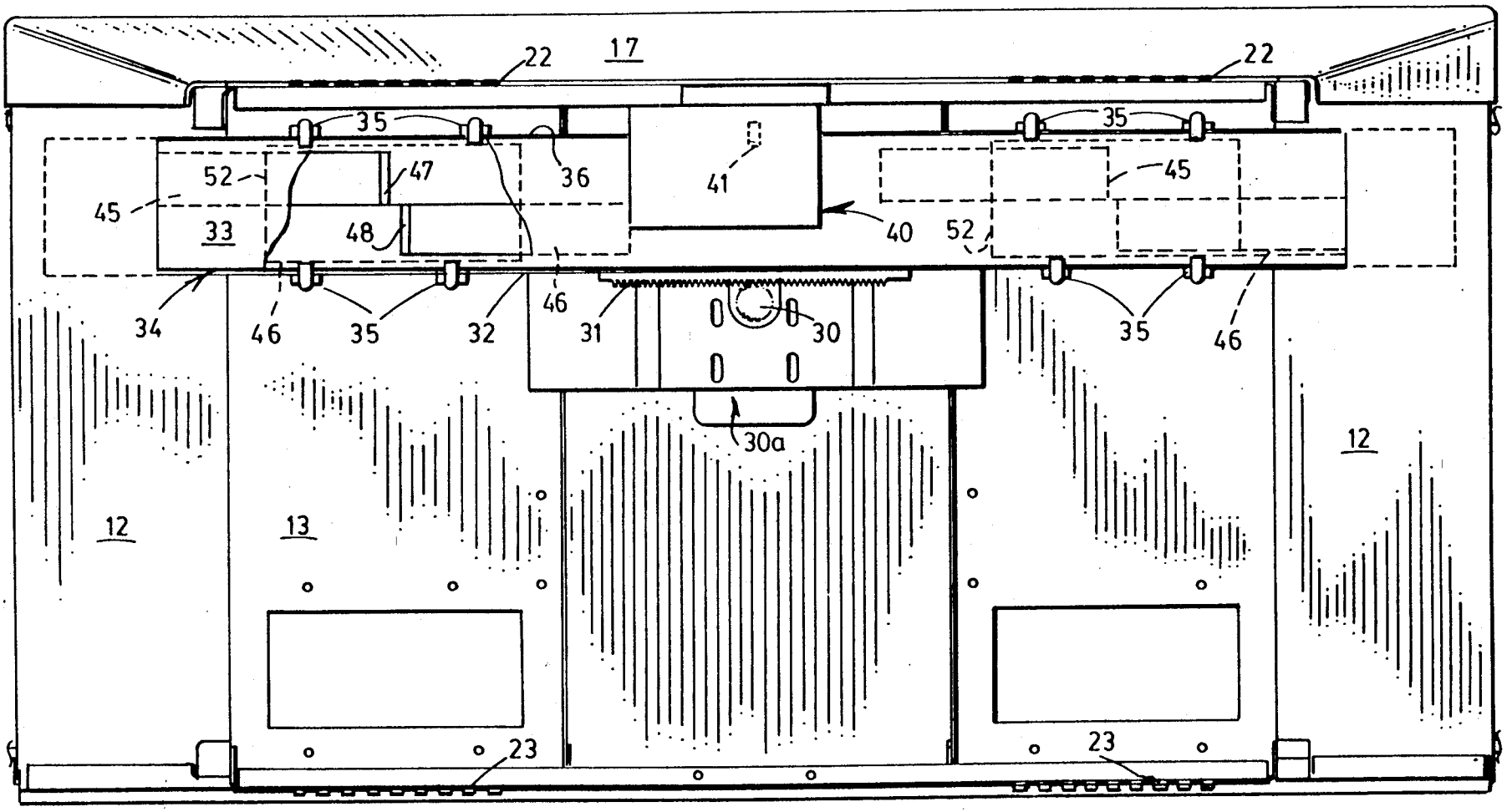
FIG. 3 is a rear elevational view of the display of FIG. 1.
Figure 4:
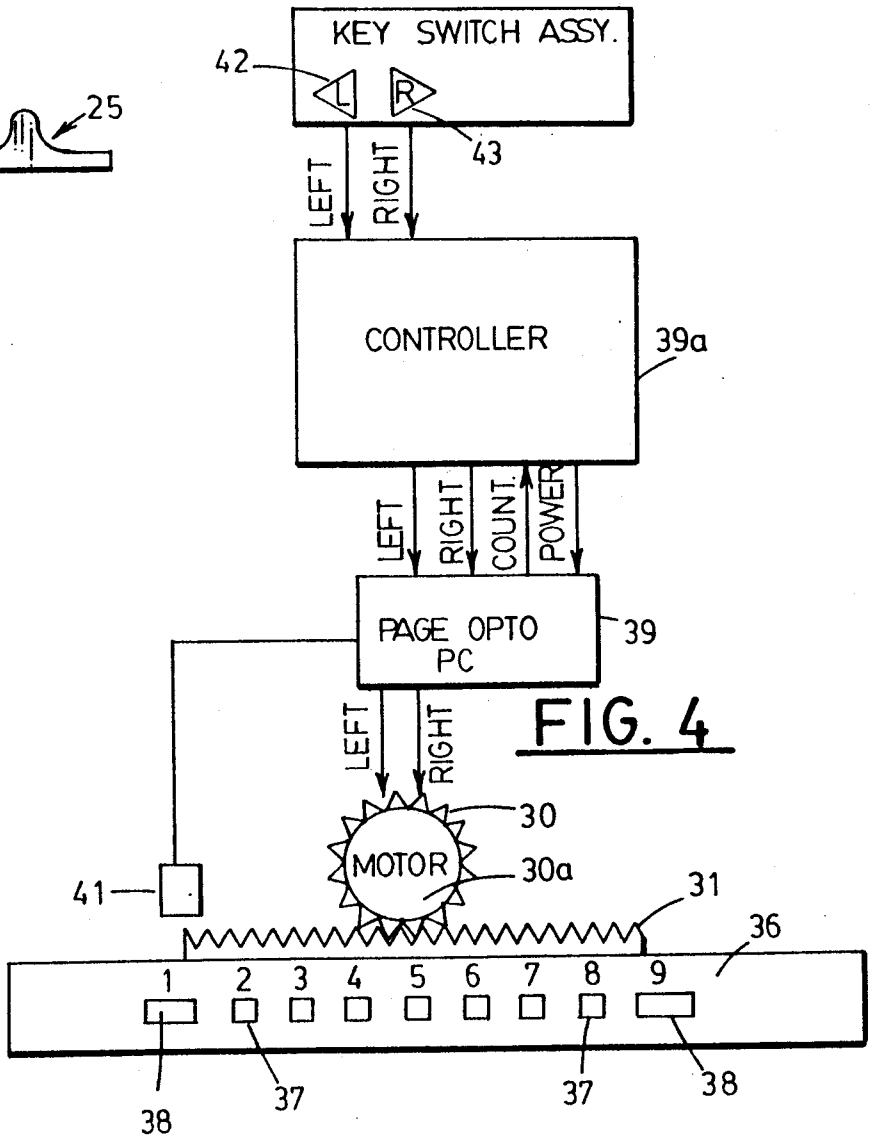
FIG. 4 is a schematic diagram of the control system for regulating page movement in the display of FIG. 1.

Turning now to FIGS. 2-4 of the drawings, means for actuating the pages 14 and 14*a*, simultaneously and in like directions will now be described.

As shown in FIG. 3, a spur gear 30 is mounted to be rotatably driven by an electric drive motor 30*a* mounted at a medial location adjacent the backside of the housing back wall 13. An overdisposed linear rack gear 31 is engaged by the spur gear 30 to translate horizontally as the gear rotates. The rack gear is fixed to the lower face of a bottom flange wall 32 formed at right angles to the operationally vertical planar body 33 of an elongated, rectangular, horizontally oriented actuator plate 34 which is mounted for sliding reciprocation in a guide track formed by a plurality of laterally spaced slide brackets 35, 35 projecting rearwardly from wall 13.

The upper margin of plate 34 (see FIG. 2) is also formed to provide a second horizontal flange wall constituting a slide bar 36 distinguished by a series of like openings 37 which are coaxially aligned and evenly spaced by intervening opaque areas of the slide bar; such openings being arranged symmetrically of the center point of the actuator plate 34. The flange wall slide bar 36 acts as a light shutter and is moveable as an integral part of and with the actuator plate. In addition to the openings 37, slide bar 36 also importantly has a pair of larger openings 38, 38 evenly spaced from adjacent the opposite ends of the series of openings 37. In the particular illustrated case there are seven openings 37 in the slide bar and two larger openings 38. In each array of book pages, there are nine pages altogether, each moveable through a limited arc determined by the spacing between the slide bar openings. For each direction of page turning all openings 37 and 38 are involved.

A metal bracket 40 is mounted on the rear face of the housing back wall 13 to extend horizontally over the slide bar 36 and downwardly parallel to and behind the actuator plate 34. Bracket 40 supports the electrical drive motor 30*a* which is controlled via a printed circuit board 39 and a micro processor controller 39*a*, such as a commercially available Zilog Corporation Model Z-80 microprocessor programmed to control the major electrical functions of the juke box, as well as operation of the page program mechanism of this invention (see FIG. 4).

To that end bracket 40 also supports an optical switch 41 operatively located adjacent the slide bar 36. This opto-switch is electrically coupled to the printed circuit 39 and conventionally constitutes a light source, such as a light emitting diode, and a photo sensor. The slide bar 36 moves between the light source and sensor of switch 41 in response to translation of the actuator plate 34. When any of the openings 37 or 38 is indexed opposite the light source and sensor a signal is supplied via the printed circuit 39 to the microprocessor controller 39*a* which among other events is programmed to record the page count and control motor energization and rotational direction.

If such signal is of short duration (in the order of 20 to 80 ms) as determined by the extent of an opening 37 in the slide bar, motor 30*a* is deenergized when the system is conditioned for manual operation. If the system is conditioned for automatic operation, the page turning operation automatically continues until a longer signal is transmitted to the microprocessor by reason of one of the larger openings 38 registering with the opto-switch 41. Typically such longer signal is in the order of 80–120 ms. When such a distinctive longer signal is fed to the microprocessor controller 39*a*, the latter is programmed, in either manual or automatic mode, to deenergize the motor and realign its circuit so that upon the next energization of the motor it will rotate in a reverse direction thereby reversing translating movement of the actuator plate 34 and slide bar 36. This activity, of course, occurs only when the last page, for either direction of page movement, has been fully turned and is in its turned position so that further movement of the actuator plate in that direction is no longer necessary or desired.

If the system is conditioned for automatic operation, reverse page movement when either of the openings 38 registers with switch 41, takes place automatically. Likewise, during the automatic mode, page movement continues without interruption as each opening 37 indexes opposite switch 41; the microprocessor reading the page count as each opening 37 and 38 registers with opto-switch 41.

When the system is conditioned for manual control, operation of customer accessible left or right direction switch means, is required. In this latter respect it will be noted from the FIG. 4 illustration that two manual switches 42 and 43 are provided, one for each direction of page movement and arranged so that a single depression or other actuation of either switch effects simultaneous movement of one page in the two book sections, such as pages 14 and 14*a*. After each page is fully turned in the two book sections, if reverse movement thereof is desired, manual operation of the appropriate switch for reverse page movement will effect that activity.

It will be understood that each operation of a direction switch 42 or 43 effects simultaneous leafing of two pages in one direction only and that motor 30*a* is deenergized at the end of each such page movement. Thus after each pair of pages are turned, leafing of the next pair of pages requires manual operation of one of the switches 42 or 43.

In order for the several pages to be moved arcuately as in turning of a book page for instance, actuator plate 34 is equipped with a first pair of axially spaced and aligned generally rectangular shaped actuator bars 45, 45 located adjacent the upper margin of plate 34 and a second pair of axially spaced like actuator bars 46, 46 located near the lower margin thereof. Each actuator bar 45 is relatively thick and has a leading end 47 which is formed at an angular rake to the longitudinal axis of its bar. Bars 46 are likewise formed with angularly formed ends 48.

Figure 2A:
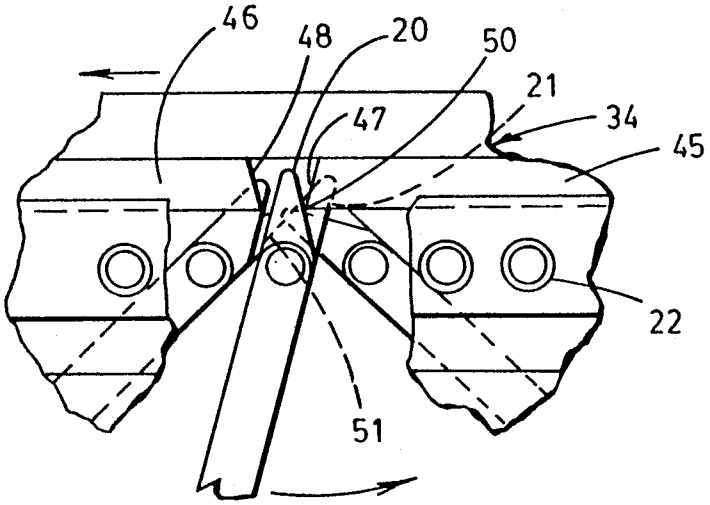
FIG. 2A is an enlarged partial top plan of the left hand page group seen in FIG. 2.

From FIGS. 2, 2A and 3 it will be recognized that the bars 45 and 46 are located on the front face of the actuator plate and project outwardly therefrom opposingly adjacent the rear face of the housing back wall 13, with one bar 45 and one bar 46 being located in vertically spaced and laterally offset parallelism on opposite sides of the mid point of the actuator plate 34. In other words one bar 45 and one bar 46 is associated with each of the two book sections or arrays in the illustrated embodiment.

Further it will be noted that the two bars 45 have their angulated ends 47 located at the left hand ends thereof as viewed in FIGS. 2 and 2A while ends 48 of bars 46 are reversely positioned. Thus the angulated ends 48 of bars 46 are at the right hand ends thereof as viewed in FIG. 2.

Such ends 47 and 48 of the actuator bars are adapted to interferingly engage angulated faces 50 and 51 of the projecting actuator tabs 20 and 21, respectively, which extend rearwardly from the pintles of the display pages through an open area 52 in the display back wall 13. As illustrated in FIGS. 2 and 2A the uppermost bars 45 engage faces 50 of the upper actuator tabs 20 for leafing successive pages in response to movement of the actuator plate to the left (see direction arrow in FIGS. 2 and 2A). The lowermost bars 46 conversely engage faces 51 of the lower tabs 21 of successive page when the actuator plate 34 moves in a reverse direction or to the right, as viewed in FIGS. 2 and 2A. Thus the pages in each book section or array are adapted to be turned sequentially in the same direction in response to operation of the actuator plate 34 in one direction, i.e., all pages leaf from left to right or vice versa depending on the movement direction of the actuator plate and bars.

Further it will be noted that once a page has been turned from its right to left position, for example, as illustrated in FIG. 2A or vice versa, the engaged faces 50 or 51 of the actuator tabs 20 or 21, as the case may be, reside against and ride along the adjacent planar face of an associated actuator bar 45 or 46. Such engagement serves to maintain a page in its turned position until movement direction of the actuator plate reverses to effect reverse movement of the pages.

It also will be understood that the spacing between the several openings in the slide bar 36 are equivalent and correspond to the desired arcuate movement of each page, with such opening spacing being uniform to effect uniform arcuate movement of the pages.

While wear and tear will occur on the gears of the described drive system as well as the actuator tabs for the pages and the actuator bars, it is to be noted that the slide bar 36 at the upper edge of the actuator plate and its optical openings 37 and 38 are independent of such wear and tear, since registration of openings 37 or 38 with the optical switch 41 occurs only when a page corresponding to a particular opening reaches its limit of right or left hand turning movement, as the case may be.

From the foregoing it is believed that those familiar with the art will readily recognize and appreciate the novel advancement of this invention over the art and will further understand that while the same has been herein described in association with the preferred embodiment thereof, illustrated in the accompanying drawings the same is nevertheless susceptible to variation, modification and substitution of equivalents without departing from the spirit and scope thereof which is intended to be unlimited by the foregoing except as may appear in the following appended claims.

The embodiments of the invention in which an exclusive property or privilege is claimed are defined as follows:

1. In an automatic coin controlled phonograph, having a record or compact disc play selector, a program display mechanism comprising:

a plurality of planar rectangular page members adapted to display a plurality of record or compact disc album covers on the front and back faces thereof;

pivot means along one longitudinal edge of each page member for pivotally supporting said page members in book like array for movement about parallel pivotal axis;

at least one pair of longitudinally spaced actuator tabs projecting outwardly from said one edge of each of said page members;

an elongated actuator plate mounted for linear sliding movement transversely of said one edge of each of said page members, means for selectively actuating said plate in either of two axial directions;

at least two elongated actuator bars mounted to project from one face of said plate;

one bar being adapted to engage one of said tabs on each page member in response to movement of said plate in one direction and the other said bar being adapted to engage the other of said tabs of each of said page members in response to movement of said actuator plate in an opposite direction whereby to pivotally move said page members one by one and bi-directionally, one direction at a time, depending on the movement direction of said plate, and optical switch means, cooperable with a series of axially spaced openings formed in a linear slide member moveable with said actuator plate for deactivating said plate actuating means whenever a said opening is registered opposite said switch means whereby to limit movement of each page member in each of said directions.

2. The combination of claim 1, wherein said means for actuating said actuator plate comprises a rotatably driven gear drivingly engaged with a linear rack affixed to said actuator plate.

3. The combination of claim 2, wherein said optical switch means controls a circuit for reversing rotation of said actuating means whereby to reverse the direction of movement of said actuator plate; the optical switch means reacting to an enlarged one of said openings to effect reverse actuation of said actuating means.

4. The combination of claim 2, wherein said means for actuating said actuator plate comprises a motor driven gear train, said optical switch means is in circuit with control means including a micro-processor for energizing, deenergizing and reversing said motor, said slide member having an enlarged opening at each end of said series of openings adapted to produce distinct signals from said optical switch means for effecting reversal of said motor.

5. The combination of claim 1, wherein said page members are pivotally mounted in at least two laterally spaced book arrays, and said actuator plate mounts at least four of said actuator bars, one pair thereof being associated with the pages of each of said book arrays and so arranged that actuation of said actuator plate in either direction simultaneously serves to pivotally move single pages of each of said arrays in like directions.

6. The combination of claim 1, and tab means overlying each album cover mounted on said pages for carrying indicia identifying a play selection to be selected by a customer.

7. In a program display mechanism for a coin operated phonograph having customer actuated record or compact disc selector means, the combination comprising:

a plurality of elongated rectangular and substantially planar page members of unitary construction having separated display areas on the front and back faces thereof;

a plurality of holding tabs bordering each of said areas for securing a record or compact disc cover in display position thereover;

at least one indicia carrying tab extending partially over the visible face of each cover mounted in a said area whereby to identify an associated record or compact disc play for selection by the customer;

an elongated pintle formed integrally with and extending along one elongated margin of each page member, means supporting opposite ends of each said pintle for pivotal movement of the associated page member;

said page members being arcuately moveable about parallel axes defined by their pintles;

comb means mounted transversely behind and intermediate the ends of the pintles of said page members and comprising a plurality of laterally spaced, co-planar, axially aligned, semi-circular separated depressions open along one side and formed along one edge of an elongated linear member;

each said depression openly receiving and supporting a said pintle intermediate its ends whereby to rigidify and support said page members during pivotal movement thereof.

8. The combination of claim 7, and a pair of axially spaced actuator tab means of general triangular shape extending outwardly of each of said pintles intermediate the ends thereof and having angulated faces along one side thereof; such faces of adjacent actuator tab means lying in intersecting planes for engagement by transversely moveable actuator bars arranged so that one of said bars engages the angulated face of one of said tabs upon movement of said one of said bars in one direction while another of said bars engages the angulated face of the other said actuator tabs in response to movement of such other bar in a second direction whereby to bidirectionally pivotally actuate said page members.

9. The combination of claim 8, in which a second pair of said actuator tabs are formed to extend from each of said pintles, one pair adjacent each end thereof in alignment for engagement by said actuator bars whereby each of said page numbers may be reversed, end-for-end, in spaced assembly.

* * * * *